US007183890B2

(12) United States Patent
Camarena Villaseñor

(10) Patent No.: US 7,183,890 B2
(45) Date of Patent: Feb. 27, 2007

(54) MAGNETIC INDUCTION DEVICE

(75) Inventor: Jose De Jesus Camarena Villaseñor, La luna 2584 Col. Jardines del Bosque, Guadalajara, Jalisco, C.P. 44520 (MX)

(73) Assignee: Jose De Jesus Camarena Villaseñor (MX)

( * ) Notice: Subject to any disclaimer, the term of this patent is extended or adjusted under 35 U.S.C. 154(b) by 64 days.

(21) Appl. No.: 11/179,176

(22) Filed: Jul. 12, 2005

(65) Prior Publication Data

US 2006/0284714 A1 Dec. 21, 2006

(30) Foreign Application Priority Data

Jun. 21, 2005 (MX) ..... JL/e/2005/000279

(51) Int. Cl.
*H01F 27/24* (2006.01)

(52) U.S. Cl. ..... 336/233

(58) Field of Classification Search ..... 336/65, 336/83, 200, 212, 233–234, 110; 252/62.51 R, 252/62.53, 62.54
See application file for complete search history.

(56) References Cited

U.S. PATENT DOCUMENTS 2,850,707 A * 9/1958 Wroblewski et al. ..... 336/83
3,339,013 A * 8/1967 Gainer et al. ..... 174/137 R
4,723,104 A 2/1988 Rohatyn ..... 318/813
6,137,390 A * 10/2000 Tung et al. ..... 336/83
6,611,187 B2 * 8/2003 Matsumoto et al. ..... 336/110
6,621,398 B2 * 9/2003 Fujiwara et al. ..... 336/178
6,891,447 B2 5/2005 Song ..... 333/24 R
6,906,608 B2 6/2005 Fujiwara et al. ..... 336/110
6,995,643 B2 * 2/2006 Fujiwara et al. ..... 336/110
2002/0159277 A1 * 10/2002 Matsumoto et al. ..... 363/21.04
2005/0030140 A1 * 2/2005 Dahlgren et al. ..... 336/5

* cited by examiner

*Primary Examiner*—Tuyen T Nguyen
(74) *Attorney, Agent, or Firm*—Buskop Law Group PC; Wendy K. Buskop

(57) ABSTRACT

An electrical energy saving device or a magnetic induction device is adapted to surround a power delivery line. The magnetic induction device applies a magnetic field region to the power delivery line to reduce amperage up to about 25%. The magnetic induction device can be a one-piece or two-piece construction formed from a molded mixture. The mixture can include from about 35 wt % to about 45 wt % of an epoxy resin; from about 30 wt % to about 40 wt % of a polymer; from about 1 wt % to about 4 wt % of dimethyl sulfoxide; from about 4 wt % to about 7 wt % of a transition metal; from about 10 wt % to about 20 wt % of a magnetic material; and from about 1 wt % to about 5 wt % of a catalyst.

20 Claims, 5 Drawing Sheets

MAGNETIC INDUCTION DEVICE

CROSS REFERENCE TO RELATED APPLICATIONS

The present application claims priority to co-pending Mexican National Patent Application Serial Number JL/E/2005/000279, filed on Jun. 21, 2005.

FIELD

The present embodiments relate generally to a magnetic induction device formed by a chemical-magnetic mixture that is used as an energy saving device.

BACKGROUND

In the design, construction, and presentation of many electrical and electronic circuits of all sorts, the use of inductive elements is relied upon for a variety of electrical circuit reactance purposes. Generally, in many alternating current circuits over a wide range of frequencies, but usually below one MHz, the use of inductors is required to counteract apparent negative resistance as such might appear in electrical terms to a source of alternating current electrical energy. For example, power factor correction circuitry for use in association with various kinds of motor control or lighting control circuits will require the use of inductive elements. Other typical circuits can include power electronics such as power supplies for a variety of electrically operating devices, or any such circuit which requires the use of a filter tank circuit to reduce variation of power factor values, and to diminish any electric noise generated or transmitted back to a power source.

Currently available inductors have a number of characteristics which have been, heretofore, difficult to avoid because the use of inductors has been required. For example, current inductors are bulky, hard to mount, expensive, and have poor tolerance—that is, the specific inductance reactance of any particular inductor might range as much as 10% to 20% of its rated value. For inductors that have tolerances in the range of 1% of rated value, the prices are significantly higher than inductors with poorer tolerance.

In general, prior art inductors require a core around which a number of windings or coils of wire such as copper wire are placed. Even with automated equipment, the production of inductors is expensive; and if inductors that have very little tolerance with respect to their rated value are required, the inductors might be required to have been manually constructed or at least manually adjusted.

Generally, a core has been required to be present in inductors, especially those relying on the permeability of the core as compared with the permeability of air to make the inductor much smaller. The cores must first be manufactured, and then the inductor wound on the cores; and thus, the inductor is both bulky and expensive. Usual cores have been ferromagnetic or permalloy, and they are thus relatively heavy due to the density of the core material. Still further, depending on the core material being used, there may be excessive eddy currents that are developed, and the hysteresis or gauss curves may be very non-linear. Even further, different materials for the core may be required depending on the intended operating frequency at which the inductor will be used. This may increase the necessity for higher inventory amounts of inductors, even though they may have the same inductive ratings; and, once again, the requirement for differing core materials adds to the cost of production and acquisition of inductors.

For a variety of reasons, inductors that are presently available may be presented in a variety of configurations. For example, the cores may be torrodial. The cores may have E-shaped core or H-shaped core configurations, or the cores may be wound on a post or bobbin, so that in all events the inductors are quite bulky. Without the addition of a mounting frame, or unless the inductors are cast or potted into a lacquer or other potting material, presently available inductors are difficult to mount, and they may be somewhat fragile in that they may be incapable of withstanding severe shocks.

If an inductor having a specific reactive value, within quite tight tolerance levels is required, that inductor must have a specific and controlled gap—which would be determined according to the manner in which the inductor is constructed—and creating a specific and controlled gap may be quite labor intensive and thus expensive.

A need exists for a device to save electric energy. The device should be composed from a combination of specials resins and magnetism that gives the device the capacity to save more energy compared to other conventional devices.

The present embodiments meet these needs.

BRIEF DESCRIPTION OF THE DRAWINGS

The detailed description will be better understood in conjunction with the accompanying following drawings.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that it can be practiced or carried out in various ways.

The present embodiments are directed towards devices used to save energy usage by machines that use inductive energy, resistant energy and capacitive energy. The embodied devices act directly by increasing the electromagnetic fields of the motor. The effect of the magnetism is that the consumption in kilowatts is decreased. The resistant current increases the electron acceleration by means of the chemical-magnetic mixture, thereby decreasing the current load, and thereby saving kilowatts/hour.

An electrical energy saving device or magnetic induction device is adapted to surround a power delivery line, such as a single power delivery line providing electricity with voltage and amperage. The embodied magnetic induction device applies a magnetic field region to the power delivery line and reduces the amperage of the electricity of up to about 25%, wherein the magnetic induction device. The embodied magnetic induction device forms a magnet field with a magnetic bias and a resistance that is applied to the power delivery line. The resistance can range from about 0.5 ohms to about 1 ohm.

The embodied magnetic induction devices increase electromagnetic energy based on the resistance and the capacity of the electric line, thereby affecting the induction in a motor to reduce electrical usage by a motor. In practice, the embodied magnetic induction devices have reduced electrical needs in a cement plant by 20%. Only one embodied magnetic induction device is needed per power delivery line incoming into a facility to reduce the overall kilowatts. The embodied magnetic induction devices can reduces need for electricity on existing lines by 20%.

Figure 1A:
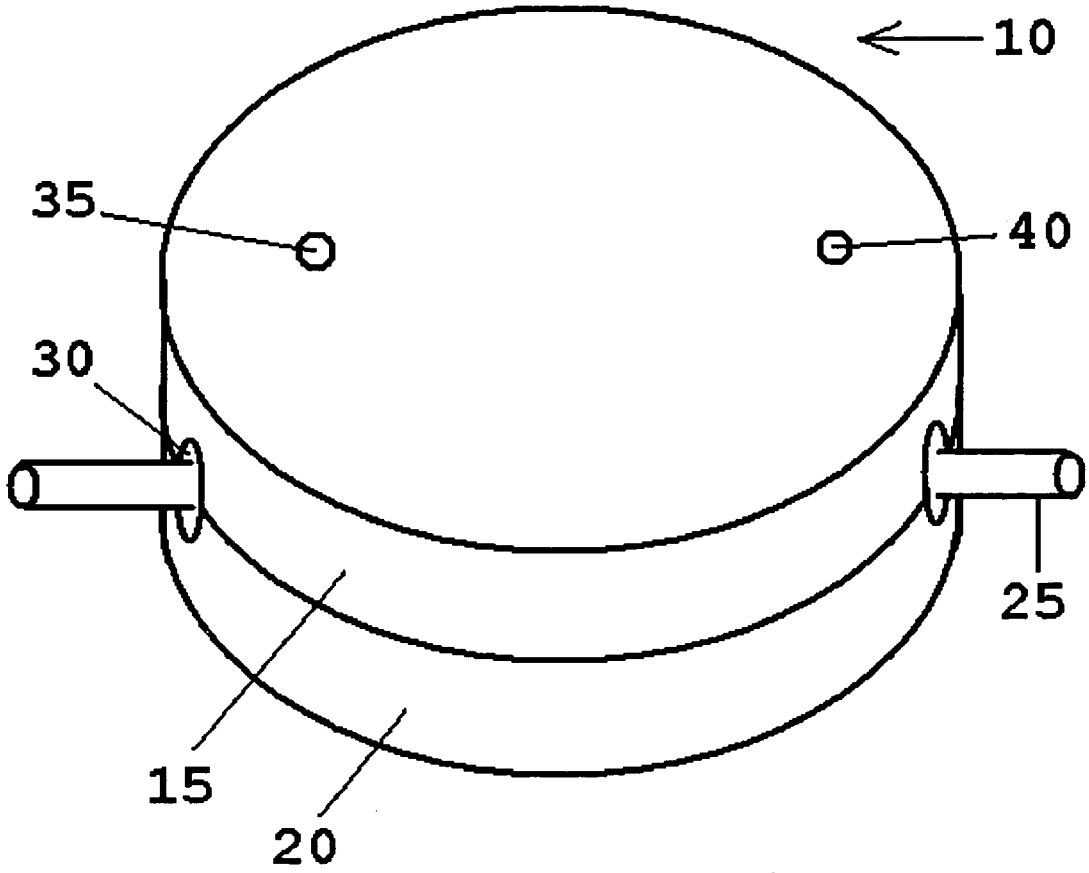
FIG. 1A depicts a perspective view of a two-piece embodiment of a magnetic induction device installed on a single power delivery line.
Figure 1B:
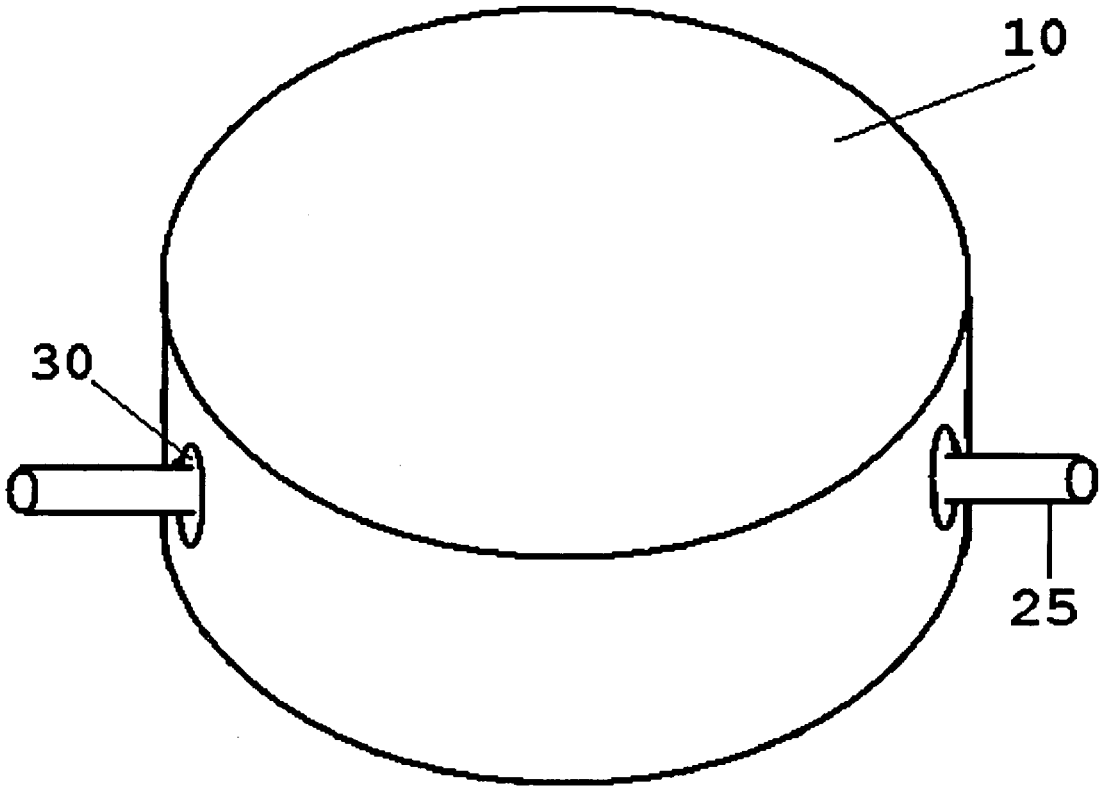
FIG. 1B depicts a perspective view of a one-piece embodiment of a magnetic induction device installed on a single power delivery line.

The embodied magnetic induction device is a one-piece or two-piece mold that includes a cavity or gap. The embodied magnetic induction device is designed so that the power delivery line runs through the device via the gap or cavity, as depicted in FIG. 1A and FIG. 1B.

The embodied magnetic induction device can be used on networks of general distribution of feeding electricity to motors and resistance directly to motors or electrical circuits. The magnetic induction device can be placed on the power delivery line incoming into a facility to reduce the overall kilowatts used by the facility. The embodied magnetic induction device applies the magnetic field region linearly along the power delivery line.

The embodied magnetic induction device is composed of from about 35 wt % to about 45 wt % of an epoxy resin, from about 30 wt % to about 40 wt % of a polymer monomer; from about 1 wt % to about 4 wt % of dimethyl sulfoxide, from about 4 wt % to about 7 wt % of a transition metal; from about 10 wt % to about 20 wt % of a magnetic; and from about 1 wt % to about 5 wt % of a catalyst.

Example polymers include polypropylene, polyethylene, polybutylene, polyamide, and combinations thereof. Example transition metals include cobalt, vanadium, molybednum, iridium, iron, zinc, titanium, and combinations thereof. Similar elemental and compound metals with similar qualities can be used. The given list includes example of the transition metals successfully used.

Examples of the magnetic material include beryllium, magnesium, calcium, radium, barium, strontium, and combinations thereof. Further examples of the magnetic material include Sm—Co magnet powder, Nd—Fe—B magnet powder, Sm—Fe—N magnet powder, and combinations thereof. Again, similar elemental and compound metals with similar qualities can be used. The given list includes example of the transition metals successfully used.

The embodied magnetic induction device can further include from about 4 wt % to about 6 wt % of a pigment. The pigment is used to color the final mold of the magnetic induction device. Examples of pigments colors include black, red, blue, grey, white, yellow, and combinations thereof. The color can be chosen to fit the end use. For example, the black color is used with low tension power delivery lines in order to blend into the power delivery system.

The embodied magnetic induction device can further include about 2 wt % to about 4 wt % of a UV stabilizer. The UV stabilizer can be added to absorb the energy of the polymer before photochemical degradation can take place. Other examples of uses for the UV stabilizer include singlet oxygen quenching, radical scavenging and hydroperoxide decomposition. Examples of UV stabilizers include benzophenones, benzotriazoles, substituted acrylates, aryl esters and compounds containing nickel or cobalt salts.

The embodied magnetic induction device can further include from about 1 wt % to about 7 wt % additive. Additives can be added to reduce brittleness of the magnetic induction device. For example, a tough polyamide resin can be added to the mixture before the mold is created. Further, an additive, such as an elastomer, can be included to improve flexural modulus of the magnetic induction device. Further, the embodied magnetic induction device can further include from about 3 wt % to about 15 wt % of a filler, such as talc.

As an example, a magnetic induction device can be a mold composed of 40 wt % epoxy resin; 33 wt % monomer; 3 wt % dimethyl sulfoxide; 4 wt % cobalt; 5 wt % black pigment; 10 wt % magnetic material; 5 wt % catalyst. The magnetic induction device can reduce the amperage up to about 25%.

With reference to the figures, FIG. 1A depicts a perspective view of a two-piece embodiment of a magnetic induction device (10) installed on a single power delivery line (25). FIG. 1B depicts a perspective view of a one-piece embodiment of a magnetic induction device (10) installed on a single power delivery line (25). The embodied magnetic induction device can have an overall diameter ranging from about 1.5 inches to about 4 inches. The embodied magnetic induction device can be formed in various shapes, such as of elliptoid, circular, rectangular. The figures depict the circular embodiment.

Figure 2:
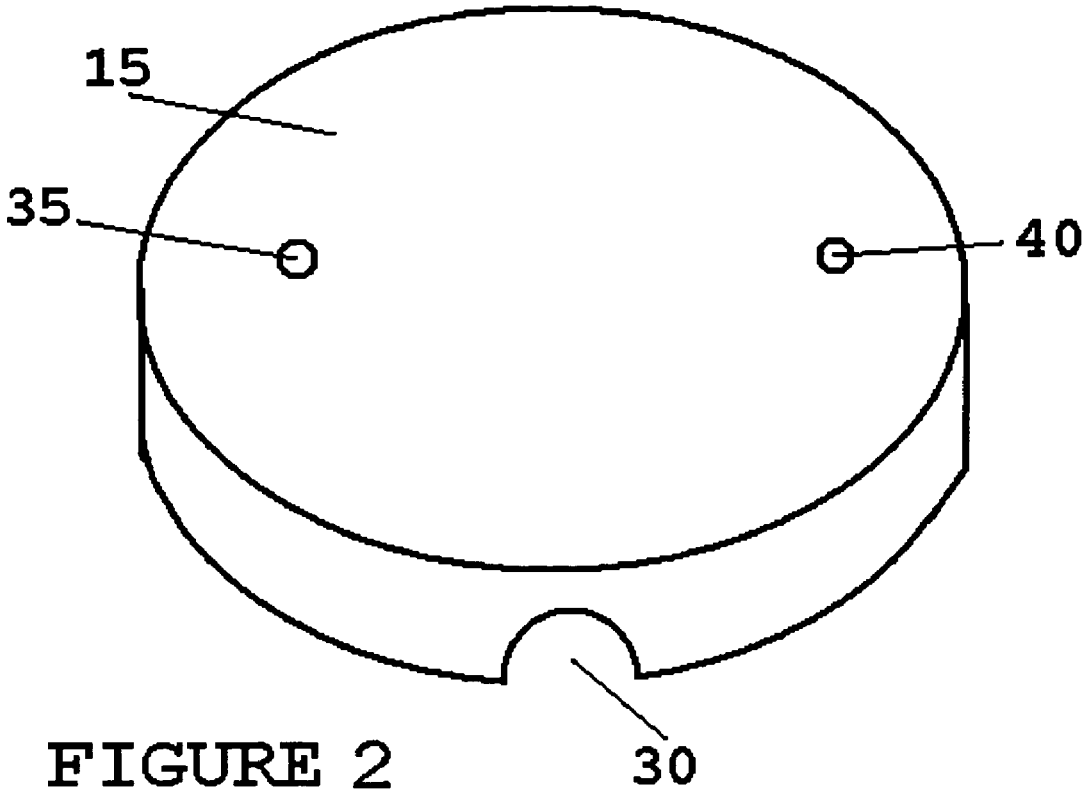
FIG. 2 depicts a perspective view of an embodiment of a piece of a two-piece embodiment of a magnetic induction device.

A two-piece embodiment of a magnetic induction device (10) is formed by joining a first section (15) and a second section (20). FIG. 2 depicts a perspective of view of a first section (15). The first section (15) has a channel or gap (30). The second section has a channel or gap that mirrors the channel or gap in the first section (15).

Figure 3:
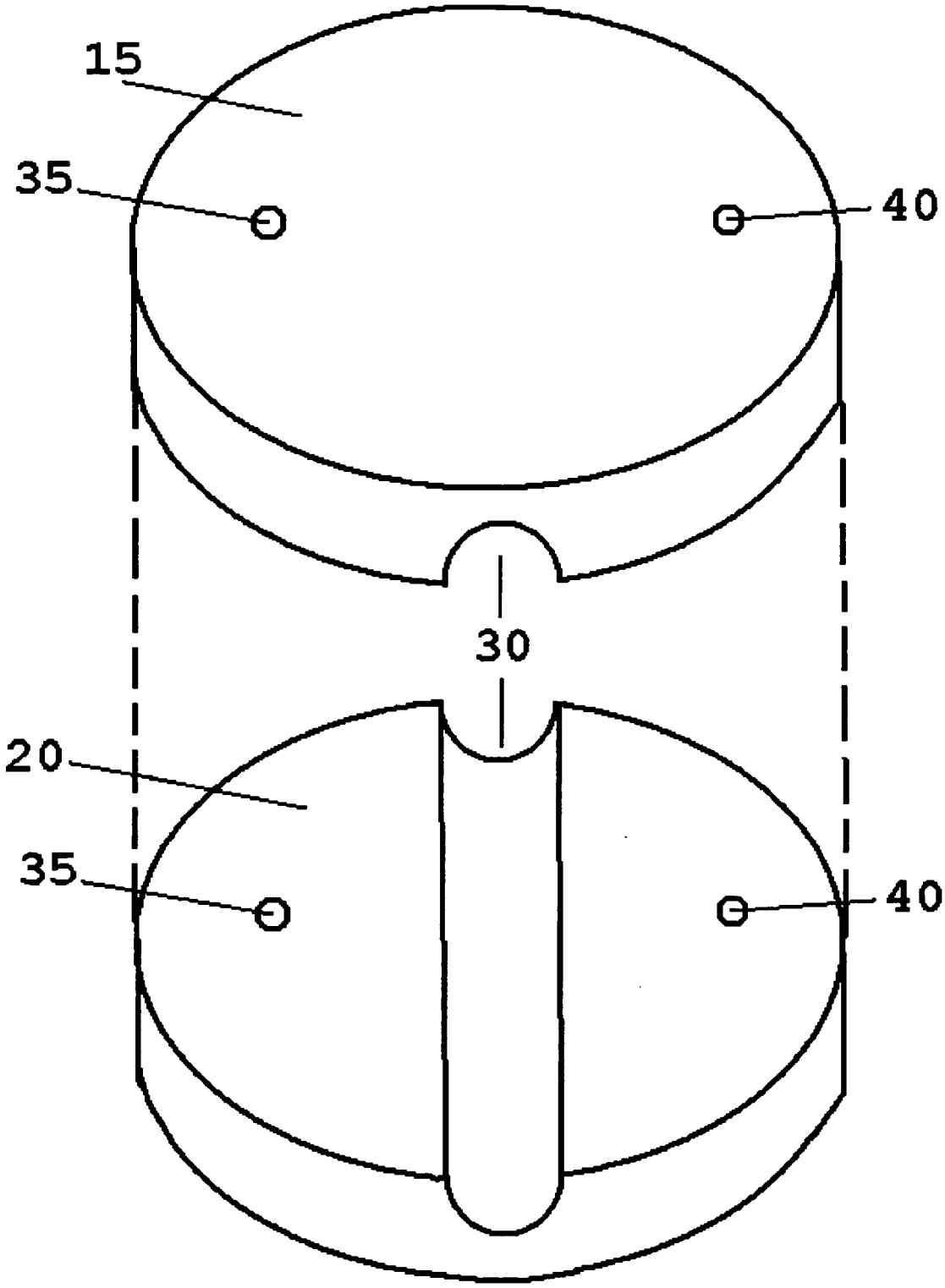
FIG. 3 depicts a perspective view of the formation of a two-piece embodiment of a magnetic induction device installed on a single power delivery line.
Figure 4:
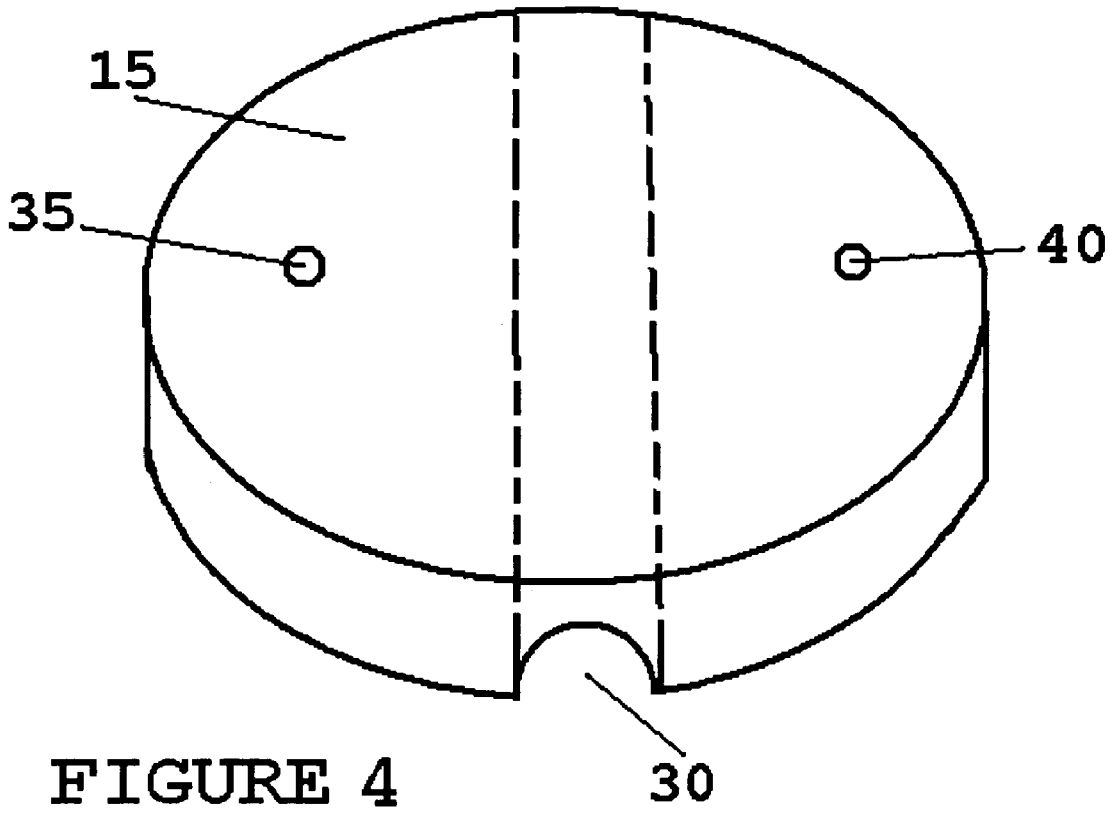
FIG. 4 depicts a perspective view of a cutaway perspective view of a one-piece embodiment of a magnetic induction device.

As depicted in FIG. 3, the first and second sections (15 and 20) are aligned so that the channel or gap (30) is aligned. The alignment of the channel or gap (30) creates a channel that extends the length of the magnetic induction device (10), as depicted in FIG. 4. The channel or gap (30) is larger than the wire diameter of the power delivery line (25) so that the magnetic induction device (10) does not add compression to the power delivery line (25).

The first and second sections (15 and 20) are held together by fasteners. The figures depict two fasteners (35 and 40), used to combine the first and second sections (15 and 20). Examples of usable fasteners include screws, threaded rivets, and non-compressing clips.

A method for making a magnetic induction device to save energy entails mixing a resin with a polymer forming a mixture. A transition metal is added to the mixture forming a metalized mixture. The transition metal can be added to the metalized mixture using a low shear mixer. Dimethyl sulfoxide is added to the metalized mixture as a liquid solution forming a liquid metalized mixture. Dimethyl sulfoxide is added as a liquid solution. Magnetic powder is added to the liquid metalized mixture forming a magnetized mixture. Next, a catalyst is added to the magnetized mixture forming a hot mixture. Adding the catalyst causes an exothermic reaction, thereby heating the hot mixture to a temperature of up to about 250 degrees F.

The embodied methods continue by pouring the hot mixture into a first mold and a second mold forming a first section and a second section. The sections are cooled to ambient temperature and removed from the molds. A gap or channel is formed in each section. The gap or channel can be formed by drilling after the mold has cooled or by the shape of the mold itself. The molds can be allowed to cool for a time period of up to three hours in order to ensure the sections have sufficiently hardened.

The sections are fastened together so that the gaps or channel in each section are aligned forming a channel or gap that internally extends the diameter or length of the device. The sections can be placed over a power delivery line so that gap or channel encloses the power delivery line without adding compression.

The embodied methods can include adding one or more of the following to the mixture: a pigment, a filler, a UV stabilizer, or other additives. Examples of additives include additives to reduce brittleness of the magnetic induction device and additives to improve flexural modulus of the magnetic induction device.

A method for making a one-piece magnetic induction device entails mixing a resin with a polymer forming a mixture; adding a transition metal to the mixture forming a metalized mixture; adding dimethyl sulfoxide to the metalized mixture forming a liquid metalized mixture; adding a magnetic powder to the liquid metalized mixture forming a magnetized mixture; and adding a catalyst to the magnetized mixture forming a hot mixture.

The hot mixture is pored into a mold to form a magnetic induction device. The mold is such that the magnetic induction device includes a gap or channel that internally extends the diameter or length of the device. The gap or channel fits around a power delivery line without adding compression. The magnetic induction device is allowed to cool to ambient temperature and is removed from the mold.

As an example method, the magnetic induction device is made by mixing 40 wt % of an epoxy resin with a 31 wt % of a monomer for between one and two minutes to form a mixture. A black pigment (5 wt %) is added during the mixing. Next, cobalt (6 wt %) or a similar transition metal is mixed into the mixture for between one and two minutes in a low shear mixer, thereby creating a metalized mixture. To form a liquid metalized mixture, dimethyl sulfoxide (3 wt %) in the form of a liquid solution is mixed into the metalized mixture for between one and two minutes. The dimethyl sulfoxide is in liquid form, but not in a water carrier. Sm—Co magnet powder (10 wt %) or other similar magnetic powder is mixed into the liquid metalized mixture for between one and two minutes, thereby forming a magnetized mixture. A catalyst (5 wt %) is mixed into the magnetized mixture for between one and two minutes. When the catalyst is added to the magnetized mixture, an exothermic reaction occurs, thereby forming a hot mixture with a temperature of up to about 250 degrees F.

The hot mixture is poured into two separate molds forming a first section and a second section. The molds are constructed to form a channel in both of the sections. The first section and the second section are allowed to cool for about thirty minutes until the sections are at ambient temperature. The sections are removed from the molds and fastened together such that the channels in each section are aligned forming a channel that extends the length of the formed device.

Although the present embodiments have been described with a certain degree of particularity, it is understood that the present disclosure is made by way of example only and that numerous changes in the detail of construction and the combination and arrangement of parts may be resorted to without departing from the spirit and scope of the invention as hereinafter claimed.

What is claimed is:

1. An electrical energy saving device comprising: a magnetic induction device adapted to surround a power delivery line, wherein the magnetic induction device applies a magnetic field region to the power delivery line, wherein the magnetic induction device comprises:

a. from about 35 wt % to about 45 wt % of an epoxy resin;
b. from about 30 wt % to about 40 wt % of a polymer;
c. from about 1 wt % to about 4 wt % of dimethyl sulfoxide;
d. from about 4 wt % to about 7 wt % of a transition metal;
e. from about 10 wt % to about 20 wt % of a magnetic material; and
f. from about 1 wt % to about 5 wt % of a catalyst.

2. The device of claim 1, wherein the magnetic induction device comprises a first half and a second half.

3. The device of claim 2, further comprising a fastener to connect the first half and the second half, wherein the first half and the second half form a gap that fits around the power delivery line without compression.

4. The device of claim 3, wherein the gap comprises a diameter ranging from about 0.25 inches to about 1.25 inches.

5. The device of claim 1, further comprising from about 4 wt % to about 6 wt % of a pigment.

6. The device of claim 5, wherein the pigment is selected from the group consisting of black, red, blue, grey, white, yellow, and combinations thereof.

7. The device of claim 1, further comprising from about 3 wt % to about 15 wt % of a filler.

8. The device of claim 1, further comprising from about 2 wt % to about 4 wt % of a UV stabilizer.

9. The device of claim 1, further comprising from about 5 wt % to about 7 wt % of an additive to reduce brittleness of the magnetic induction device.

10. The device of claim 1, further comprising from about 1 wt % to about 3 wt % of an additive to improve flexural modulus of the magnetic induction device.

11. The device of claim 1, wherein the magnetic field region is applied linearly to the power delivery line.

12. The device of claim 1, wherein the magnetic field region reduces amperage in the power delivery line by between about 15% and about 20%.

13. The device of claim 1, wherein the magnetic induction device comprises a shape that is selected from the group consisting of elliptoid, circular, and rectangular.

14. The device of claim 1, wherein the magnetic induction device comprises an overall diameter ranging from about 1.5 inches to about 4 inches.

15. The device of claim 1, wherein the magnetic induction device is placed on the power delivery line incoming into a facility.

16. The device of claim 1, wherein the polymer is selected from the group consisting of polypropylene, polyethylene, polybutylene, polyamide, and combinations thereof.

17. The device of claim 1, wherein the transition metal is selected from the group consisting of cobalt, vanadium, molybednum, iridium, iron, zinc, titanium, and combinations thereof.

18. The device of claim 1, wherein the magnetic material is a magnetic powder selected from the group consisting of beryllium, magnesium, calcium, radium, barium, strontium, and combinations thereof.

19. The device of claim 1, wherein the magnetic material is a magnetic powder selected from the group consisting of a Sm—Co magnet powder, Nd—Fe—B magnet powder, Sm—Fe—N magnet powder, and combinations thereof.

20. The device of claim 1, wherein the magnetic induction device form a magnet with a magnetic bias and a resistance to be applied to the power delivery line, wherein the resistance is between 0.5 ohm and 1 ohm.

* * * * *